US006902164B2

(12) United States Patent
Gilbert

(10) Patent No.: US 6,902,164 B2
(45) Date of Patent: Jun. 7, 2005

(54) PUZZLE GAME AND METHODS OF PLAYING THEREOF

(76) Inventor: Andrea Naomi Gilbert, 2A, Reading Road, Lower Basilden, Birkshire (GB) RG8 9NL ( * ) Notice: Subject to any disclaimer, the term of this patent is extended or adjusted under 35 U.S.C. 154(b) by 0 days.

(21) Appl. No.: 10/630,919

(22) Filed: Jul. 31, 2003

(65) Prior Publication Data

US 2005/0023754 A1 Feb. 3, 2005

(51) Int. Cl.[7] ..... A63F 3/00
(52) U.S. Cl. ..... 273/239; 273/242
(58) Field of Search ..... 273/239, 275, 273/157 R, 242, 441, 236

(56) References Cited

U.S. PATENT DOCUMENTS 3,695,615 A * 10/1972 Shoptaugh ..... 273/275
3,804,415 A * 4/1974 Ryan ..... 273/275
4,326,720 A * 4/1982 Erlich ..... 273/239
5,269,531 A * 12/1993 McNamara ..... 273/275

* cited by examiner

*Primary Examiner*—Vishu K. Mendiratta

(57) ABSTRACT

A puzzle game and method of playing includes a pegboard frame having a plurality of recesses therein. A challenge card is placed on an upper surface of the pegboard frame. A plurality of posts are placed through the openings in the challenge card and contact the recesses in the pegboard frame. A plurality of elongated planks are placed between adjacent posts, and a figurine is placed at one side of the challenge card on one of the posts. The figurine traverses the challenge card from one side to another side in a series of segments, with each segment including traversing from one of the posts to another of the posts along a plank disposed therebetween. The plurality of planks are initially positioned on the challenge card to thereby require sequences in which planks must be lifted and repositioned between others of the plurality of posts as the figurine traverses the challenge card.

20 Claims, 5 Drawing Sheets

PUZZLE GAME AND METHODS OF PLAYING THEREOF

BACKGROUND OF THE INVENTION

1. Field of the Invention

The invention is broadly directed to games, and more specifically to games of skill used by one or more players for enjoyment as well as for exercising the mind through progressive and continual challenges.

2. Description of the Related Art

There exist a large variety of game categories including card games, board games, multi-player games, single-player games, arcade games, computer games, and the like. Popular game categories include puzzles and "mind-games" where the player must strategize or think through various levels of challenges that are presented. The games can be played alone or with others. In addition to enjoyment, the games develop valued attributes such as planning, critical thinking and strategic decision-making.

Some puzzles and mind-games are geared towards a younger audience, while others are directed at an older audience. It is difficult to create a game that combines straight-forward rules with various levels of complexity that would appeal to young and old alike.

Accordingly, there is a persistent need for puzzles and games that are fun to play and that can continually challenge a wide range of users.

SUMMARY OF THE INVENTION

The present invention is directed to a puzzle game and methods of playing the game. One object of the present invention is to create a puzzle that is fun to play and has straight-forward rules, while developing critical thinking attributes.

Another object of the present invention is to create a puzzle game and method of playing in which the user is continually challenged using starting scenarios having different levels of complexity.

Yet another object of the present invention is to create a puzzle game and method of playing that can be used and enjoyed by a wide variety of users, both in age and skill level.

To achieve these and other objects, the present invention provides a puzzle game and method of playing the puzzle game, including the steps of providing a pegboard frame having a plurality of recesses therein. A challenge card is placed on an upper surface of the pegboard frame, the challenge card having a plurality of openings corresponding to certain ones of the plurality of recesses in the pegboard frame. A plurality of posts are placed through the openings in the challenge card and contact the recesses in the pegboard frame. A plurality of elongated planks are placed between adjacent ones of the plurality of posts in selected locations, and a figurine is placed at one side of the challenge card on one of the plurality of posts. The figurine traverses the challenge card from one side to another side in a series of segments, with each segment including traversing from one of the plurality of posts to another of the plurality of posts along one of the plurality of planks disposed therebetween. The plurality of planks are initially positioned to require sequences in which planks must be lifted and repositioned between others of the plurality of posts as the figurine traverses the challenge card.

BRIEF DESCRIPTION OF THE DRAWINGS

The above objects and other advantages of the present invention will become more apparent by describing in detail the preferred embodiments thereof with reference to the attached drawings in which.

DETAILED DESCRIPTION OF PREFERRED EMBODIMENTS

The present invention will now be described more fully with reference to the accompanying drawings, in which preferred embodiments of the invention are shown. The invention may, however, be embodied in many different forms and should not be construed as being limited to the embodiments set forth herein. Rather, the embodiments are provided so that this disclosure will be thorough and complete, and will fully convey the concept of the invention to those skilled in the art.

Broadly described, the present invention relates to a puzzle game designed to provide enjoyment and promote critical thinking through mental exercises. The ultimate objective of the exemplary "river crossing" puzzle described in detail herein is to help a "hiker" find a route across an animal infested river. Tree stumps dot the crossing, and a few handy old planks are scattered nearby. The hiker must reach the planks and bridge the stumps, while avoiding the animals below. Different game themes are contemplated within the scope of this invention, and one of ordinary skill in the art would understand that the components described below could be adapted or substituted to conform to the particular theme chosen for the game.

The structure of the puzzle, and the method of playing (both in person and online) will now be described in greater detail.

Figure 1A:
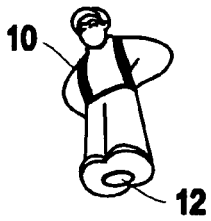
FIGS. 1A–1H are perspective views of the various puzzle components, and which illustrate one of a number of game themes that may be employed.

The puzzle components for the illustrated "river crossing" theme will be described with reference to FIG. 1. The figurine 10 in FIG. 1A must traverse from one side of the river to the other. The figurine identified in FIG. 1A is a "hiker" to conform to the river crossing game theme, but any type of figurine may be used in the context of this invention. The hiker 10 may have a magnet 12 disposed in its lower portion or base area, which is used to magnetically contact the planks (described later).

Figure 1B:
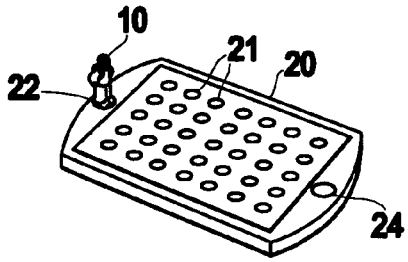

In FIG. 1B, the pegboard game frame 20 provides the underlying grid of recesses 21 for all challenge card stump locations. Pegboard game frame 20 may also have at least one, and preferably two magnetic locations 22 and 24 (indicated by graphic circles) on opposing sides, to enable the hiker 10 to "rest" between challenges, by magnetically coupling the hiker 10 to the pegboard 20. This also ensures the hiker 10 will not be "lost" between game plays. While the pegboard 20 shown in FIG. 1B presents an orthogonal grid, other grid geometries are contemplated and could be accommodated within the scope of the present invention. For example, a triangular, circular or hexagonal grid may be employed.

Figure 1C:
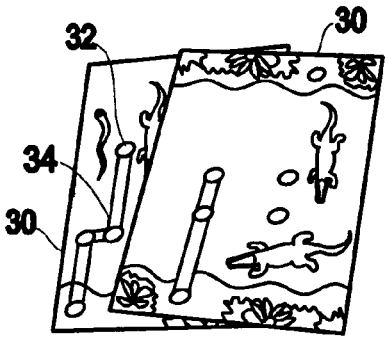

FIG. 1C depicts the challenge cards 30, and each card 30 provides pre-defined openings or holes 32 for placement of tree stumps. The challenge cards 30 also have pre-designated shaded regions 34, which identify the initial placement locations for the planks prior to commencing that specific challenge. Each of the challenge cards 30 is unique. The challenges are designed for beginners to experts, and present various levels of complexity to test the player. The challenge cards 30 may be color-coded, numbered or otherwise identified according to level of difficulty, for example, beginner, intermediate, advanced or expert. By developing a range of puzzles through the challenge cards 30, players' young and old will find a level that will challenge their skills. Of course, the game may be packaged so that it contains just one, or any number of challenge levels.

Figure 1D:
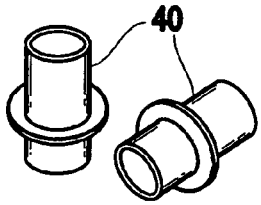

Cylindrical posts or tree stumps 40 in FIG. 1D are strategically placed through holes 32 in each of the challenge cards 30 and into the corresponding recess 21 in pegboard game frame 20. Again, in this discussion, the posts 40 are tree stumps to conform to the river crossing game theme. Posts of different shapes and sizes are contemplated within the scope of this invention. The pegboard game frame 20 as shown in FIG. 1B includes 35 recesses, but different numbers of recesses are contemplated within the scope of the invention. Each challenge card stump setup is unique, which provides a different challenge for each game. The puzzle as played includes 20 tree stumps, but any number may be accommodated.

Figure 1E:
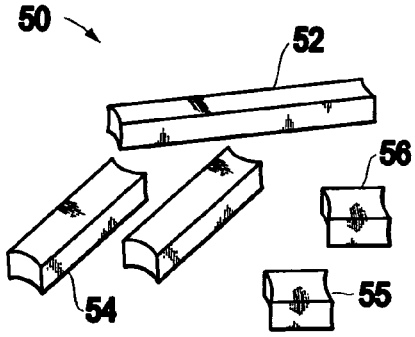

As shown in FIG. 1E, planks 50 of various lengths are provided. The planks 50 are strategically placed on the pre-designated shaded portions 34 of the challenge card 30 prior to starting the game. One long-length plank 52, two medium-length planks 54 and two short-length planks 56 are provided. Of course, different numbers and lengths of planks 50 are contemplated within the scope of the invention. The different lengths foster different challenges for each game situation, requiring continual assessment of the crossing strategy as the game progresses.

Since the plurality of planks 50 provided with each challenge at the start of the game are not all contiguous, or there are an insufficient number of planks 50 to cross the entire river, the hiker 10 must move across the river by lifting and repositioning planks 50 between stumps 40 in repeated sequences. In other words, the plurality of planks 50 are initially positioned to require sequences in which the planks 50 must be lifted and repositioned between the stumps 40 as the hiker 10 traverses the challenge card 30.

Figure 1F:
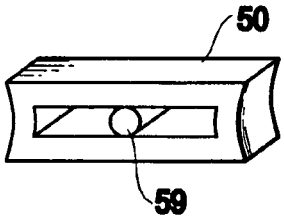

As shown in FIG. 1F, which is a bottom view of the plank, a magnet 59 may be centrally located in an underside of each of the planks 50 (collectively 52, 54 and 56). During game play, the magnet 12 in the hiker's 10 base area contacts the magnet 59 in the plank 50. This helps to firmly position the hiker 10 on the plank 50, as well as allow the hiker 10 to magnetically couple and lift the plank 50 and reposition it as the game progresses.

Note also that the ends of each of the planks 50 contain a recessed curved portion 55 that conforms too, and mates with the cylindrical outer form of the tree stumps 40, ensuring a sung fit to avoid horizontal displacement during game play, but which allows the plank 50 to be easily extracted in the vertical direction. Different mating surfaces between the ends of the planks 50 and stumps (posts) 40 are contemplated within the present invention to ensure the horizontal displacement is minimized, while allowing for vertical extraction. For example, the post 40 may be square and the ends of the plank 50 would have a recessed triangular portion to mate with the corner of the square post 40.

Figure 1G:
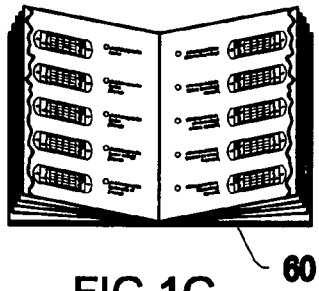
Figure 1H:
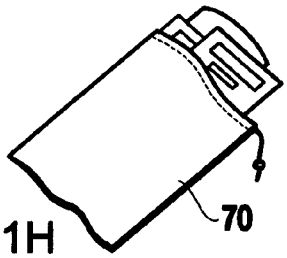

An instruction/solution booklet 60 in FIG. 1G includes complete how-to-play instructions plus a move-by-move solution code for each challenge card. A bag 70 as shown in FIG. 1H can also be provided to keep the various components of the game together during travel or storage.

Figure 2A:
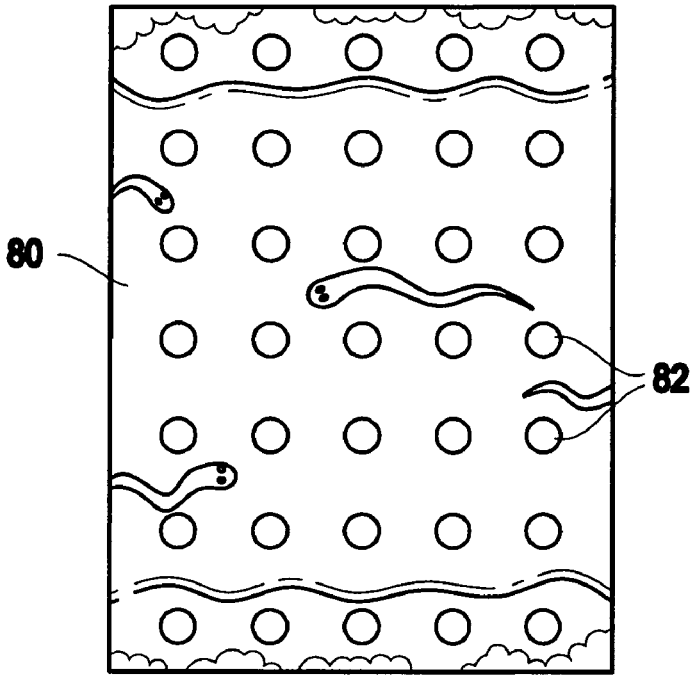
FIGS. 2A and 2B depict a universal challenge card and a template for additional challenges.
Figure 2B:
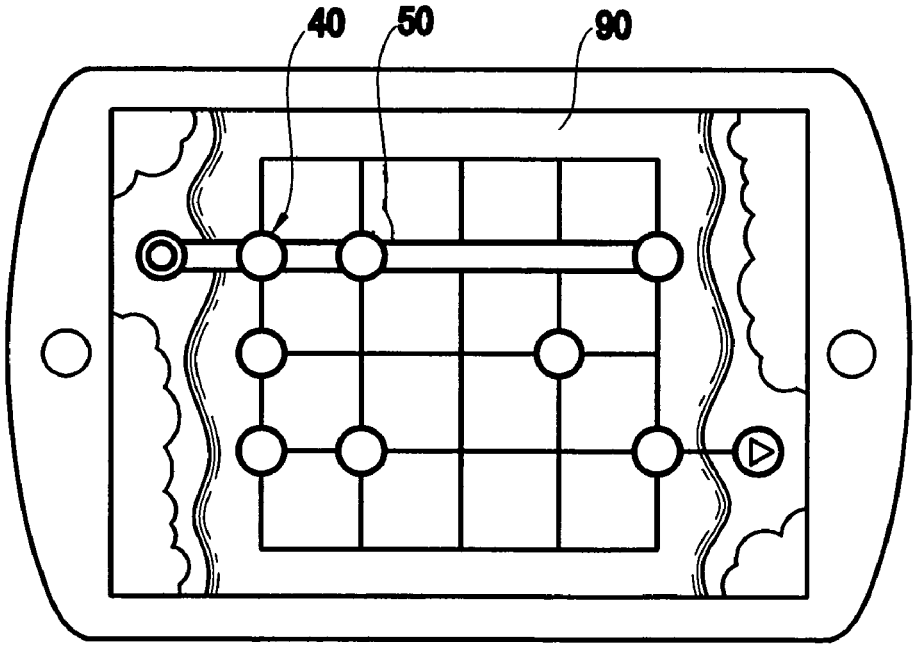

FIG. 2A depicts a "universal card" 80 with a plurality of holes 82 matching all the recesses 21 in pegboard game frame 20. This card can be used to play bonus challenges provided by the game vendor, for example, through a web site or via additional hard copy materials that are provided after the game has been purchased. For example, the web site of the game vendor would depict a template pattern 90 in FIG. 2B, illustrating the starting placements of the stumps 40 and planks 50. The user would place the universal card 80 on the pegboard game frame 20 and then place the stumps 40 in the holes 82, and place the planks 50 on the universal card 80, in accordance with the template pattern 90 depicted on the web site. Such interactivity ensures that the users will never become bored with the game, as they can always pursue new challenges.

The game set-up, playing rules and methods of play will now be described in greater detail.

Figure 3A:
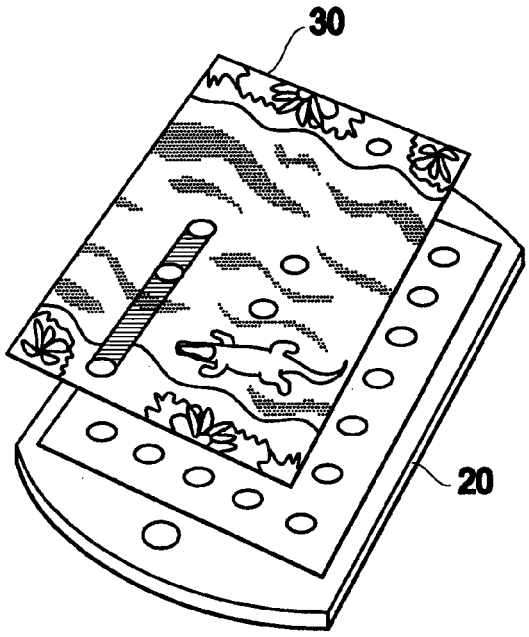
FIGS. 3A–3D are perspective views of the puzzle and challenge cards during the initial set-up process before commencing the game.
Figure 3B:
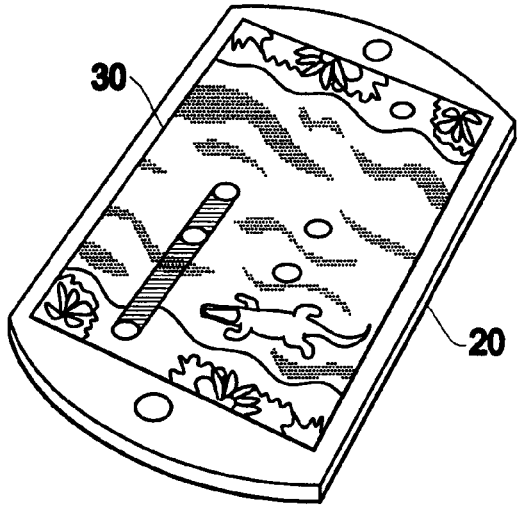
Figure 3C:
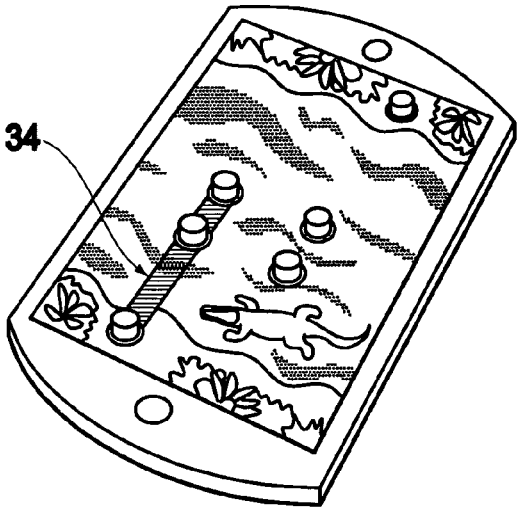
Figure 3D:
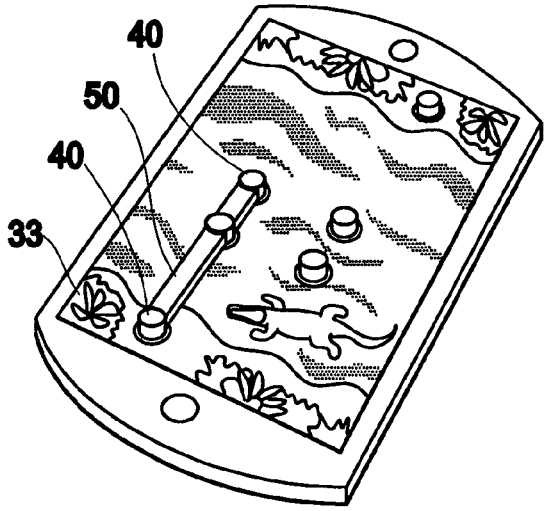

Referring to FIGS. 3A–3D, during the set-up process, a challenge card 30 is placed on an upper surface of the pegboard game frame 20 as shown in FIGS. 3A and 3B. Then, the stumps 40 are placed through the holes 32 in each challenge card 30 and reside in the recesses 21 of the pegboard game frame 20 as shown in FIG. 3C. Finally, planks 50 (of different lengths 52, 54 and 56) are placed on the corresponding pre-designated shaded regions 34 of the challenge card 30, and fit snugly between two stumps 40 when placed. Note that not all the planks 50 may be contiguous at the start of the game, or there may be an insufficient number of planks 50 to reach the other side (as shown in FIG. 3D), thereby requiring sequences were the hiker 10 must lift and reposition the planks 50 while moving across the challenge card 30. The hiker 10 can start on the shore nearest the card number 33 printed on the challenge card 30 as shown in FIG. 3D.

Figure 4A:
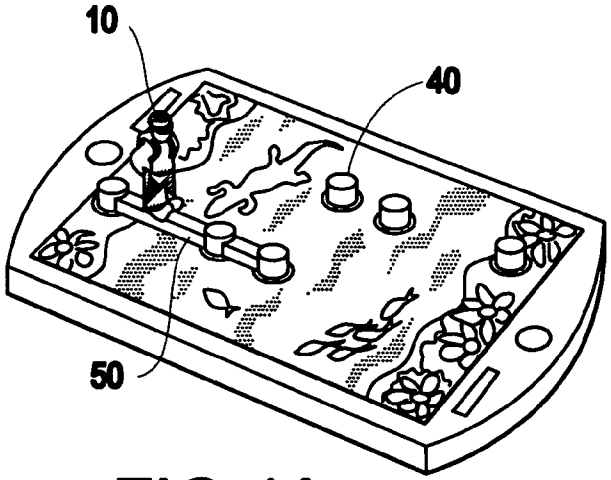
FIGS. 4A–4D are perspective views of the puzzle showing how the game is played with a simple example.
Figure 4B:
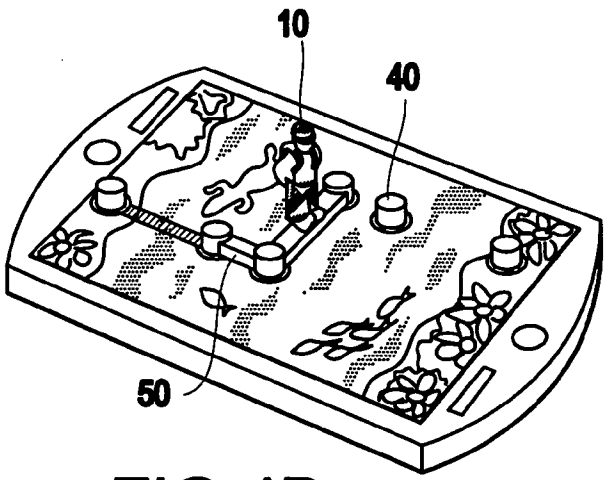
Figure 4C:
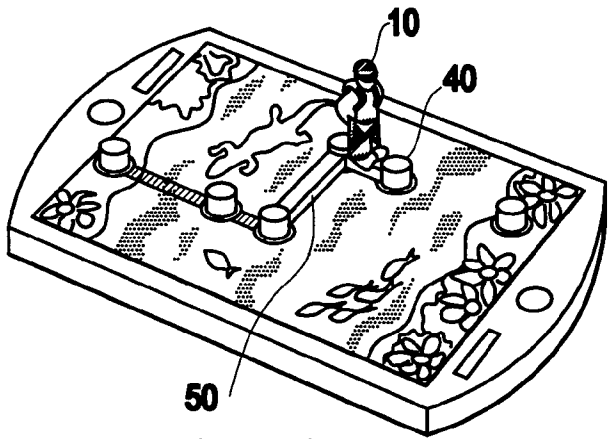
Figure 4D:
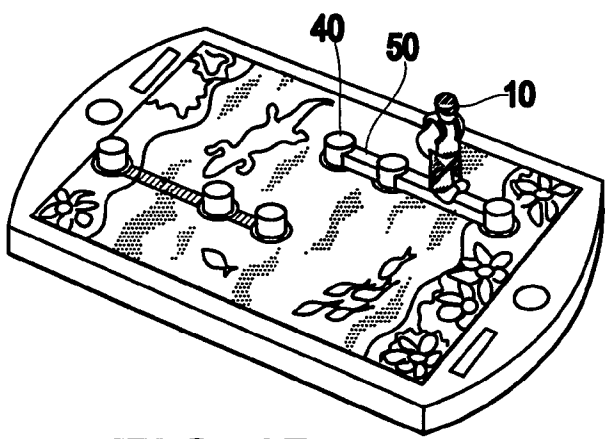

To play the game, the hiker 10 moves by walking along a plank 50 to get to the next stump 40. The hiker 10 cannot get from stump to stump by jumping—the hiker 10 must move planks 50 to bridge the gaps between stumps 40. The hiker 10 can pick up and move one plank 50 at a time, but the hiker 10 can only reach and move a plank 50 contacting the stump 40 where he is currently standing. See FIGS. 4A and 4B. The planks 50 must fit snugly between two adjacent stumps 40, so the hiker 10 can only move a plank 50 of a certain length (52, 54 or 56 as shown in FIG. 1E) to a space between two stumps 40 that corresponds to the length of the plank 50. Once reaching a stump 40, the hiker 10 can pick up any plank 50 contacting the stump 40 in any direction, and carry it along another plank 50 as far as he is able to go before putting it down again. See FIGS. 4C and 4D. Each movement between the stumps 40 is referred to as a segment, and each segment requires a sequence of lifting and repositioning the planks until the hiker 10 reaches the other side of the challenge card.

The plank 50 lifting and repositioning sequences are made easier by the magnetic coupling between the magnet 12 in the base area of the hiker 10 and the magnet 59 in each of the planks 50, as described above.

The rules of the game may include the following:

No jumping is allowed between stumps 40 or planks 50 or from a stump 40 to shore.

The hiker 10 can pick up and move or carry a plank 50 if one end touches the stump 40 where he is standing.

The hiker 10 can only pick up or carry one plank 50 at a time.

Planks 50 must be supported between stumps 40 on both ends, and must be an exact fit.

Planks 50 cannot be placed diagonally, only north-south or east-west.

Planks 50 cannot support other planks 50.

Planks 50 cannot be stacked.

Planks 50 cannot cross over other stumps 40 or planks 50 in the way.

Of course, any or all of these rules can be modified to increase, decrease or change the challenges, and such modifications are contemplated within the scope of the present invention. For example, if the underlying geometry of the pegboard 20 grid were modified, from orthogonal to triangular or hexagonal, the game rules could allow for placement of the planks 50 in many directions, not just north-south or east-west.

In addition, in another embodiment of the game, two or more hikers 10 may have to cross the river together. In such cases, the hikers 10 may have to work cooperatively, passing planks 50 back and forth in order to get everybody across. Also, different hikers 10 may have different talents and abilities; for example, some hikers 10 may be able to only lift short-length planks 56, not the long-length planks 52. Still further, the game rules may be modified so that the hikers 10 have to locate a treasure or a prize at the far side of the river, and then bring the treasure or prize back across the river. In such a case, there could be a rule providing that if a hiker 10 is holding a treasure or prize, they cannot pick up a plank 50.

As a player becomes familiar with the game, some helpful strategic moves will emerge. The simplest moves are just relays, that is, proceeding to the end of the first plank 50, stepping on the stump 40, turning and picking up the plank 50 previously traversed, carrying it along the next plank 50, and putting the first plank 50 down again to form the next bridge between adjacent stumps 40. Sometimes the hiker 10 might have to get clever and leave a plank 50 behind in a spot where it will come in handy later. Sometimes the hiker 10 will move a plank 50 just to clear a path so it does not block where he wants to go. The strategies become more complex as the player progresses through the different challenge levels. The complexity of the game is determined by the inter-relationship between the number of posts, the number of planks, the placement of the planks, and the number of steps needed to traverse the challenge card.

The player can play the game on the physical board provided and described above, and when all the challenge cards 30 are mastered, the player can seek supplemental challenges from the game vendor, via a web site or hard copy distribution as described above. Also, the players may wish to design their own challenges using the universal card 80. In addition, the "game board" may be painted or otherwise patterned on a suitable substrate, such as a large tarp or canvas. In such cases, the stumps 40 and planks 50 could be large cardboard cutouts so that people actually have to do the walking and plank moving to solve the puzzle. Again, as described above, single players or teams may be used on such a large game board.

The game may also be produced in versions patterned on smaller suitable substrates, such as paper or cardboard. In such cases, the stumps 40 and planks 50 could also be cardboard cutouts to facilitate game play.

Still further, the game itself could be played on a computer, whether a stand-alone computer, via the Internet, or via a portable computerized device such as a GameBoy®, cell phone, or personal digital assistant (PDA).

Figure 5:
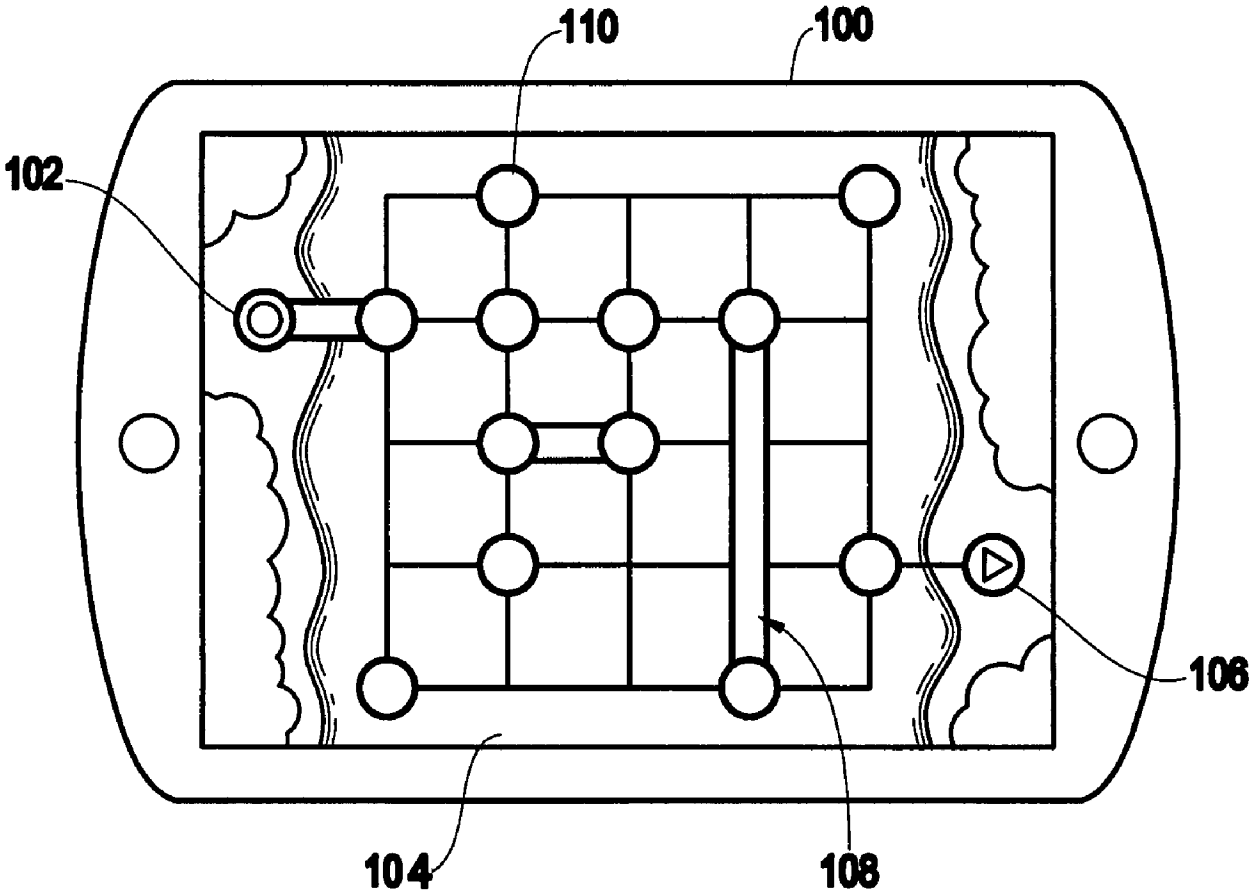
FIG. 5 illustrates an applet running on a personal computer, showing the puzzle as it appears on screen prior to commencing a game.

For example, as shown in FIG. 5, a web site could contain a series of game board scenarios 100 that can be played online. The rules of the computerized game are the same as the physical version, but since it is displayed on a video terminal of some sort and viewed in two-dimensions rather than three, there are a few modifications that need to be considered. As shown in FIG. 5, the player starts the game on a starting post 102 on the left side of the board; the object is to cross the river (the blue box) 104 and end at a finishing post 106 on the right side of the board 100. To accomplish this, the player needs to move the "virtual planks" 108 across the playing grid, between "virtual stumps" 110 until one of the virtual planks 108 reaches the right side.

To move a virtual plank 108, the player would simply click on it with a mouse (which shadows the virtual plank 108 into an outline), and then move and click on the spot between two virtual stumps 110 where you want the virtual plank 108 to be placed next. If it is a legal move, the computer will let you do it; if not, the player must figure out what is wrong and then make a legal move. In addition to a mouse, other conventional input devices to select and reposition the virtual planks 108 planks are contemplated within the scope of this invention. To make the game easier for younger players, virtual planks 108 that could be moved legally may be bounded by virtual stumps 110 of a first color, and virtual planks 108 that cannot be moved legally may be bounded by virtual stumps 110 of a second color. The online game proceeds in the same fashion, with the same rules, as described above with regard to the physical game.

Gaming continues to be a growing industry and there is always a need for new games that players will enjoy and will continue to play. It is important that any new game be easy to understand and that the game provided multiple opportunities to win. Also, by having access to the additional online challenge games, a player will have new challenges and will not become frustrated with the game and abandon it.

While the present invention has been described in detail with reference to the preferred embodiments thereof, it should be understood to those skilled in the art that various changes, substitutions and alterations can be made hereto without departing from the scope of the invention as defined by the appended claims.

What is claimed is:

1. A method of playing a puzzle game, the method comprising:

providing a pegboard frame having a plurality of recesses therein;

providing a challenge card placed on an upper surface of the pegboard frame, the challenge card having a plurality of openings corresponding to certain ones of the plurality of recesses in the pegboard frame;

providing a pre-determined plurality of posts placed through the openings in the challenge card and contacting the recesses in the pegboard frame;

providing a pre-determined plurality of elongated planks on the challenge card, each of the pre-determined plurality of planks being placed between adjacent ones of the pre-determined plurality of posts;

providing a figurine at one side of the challenge card; and traversing the challenge card from the one side to another side by moving the figurine from one segment to another, wherein each segment comprises traversing from one of the pre-determined plurality of posts to another of the pre-determined plurality of posts along one of the pre-determined plurality of planks disposed therebetween, and wherein the pre-determined plurality of planks are initially positioned on pre-designated regions on the challenge card to thereby require sequences in which one of the pre-determined plurality of planks must be lifted and repositioned between others of the pre-determined plurality of posts as the figurine traverses the challenge card.

2. The method of claim 1, wherein the providing a challenge card step includes providing a challenge card of a first complexity for a first game, and providing a challenge card of a second different complexity for a subsequent game.

3. The method of claim 2, wherein the complexity of the challenge card is determined by a number of the segments the figurine must traverse, the placement of the pre-determined plurality of planks, a number of pre-determined plurality of posts, and a number of the sequences of lifting and repositioning the planks.

4. The method of claim 1, wherein the providing a challenge card step includes providing a universal challenge card having a plurality of openings corresponding to all of the plurality of recesses in the pegboard frame, and further comprising viewing a challenge card pattern;

providing the pre-determined plurality of posts placed through the openings in the universal challenge card and contacting the recesses in the pegboard frame according to positions of the posts depicted on the challenge card pattern; and providing the pre-determined plurality of elongated planks, each of the pre-determined plurality of planks being placed between adjacent ones of the pre-determined plurality of posts according to positions of the planks depicted on the challenge card pattern.

5. The method of claim 4, where the challenge card pattern is accessible via a computer network connected to a web site of a puzzle vendor.

6. The method of claim 1, wherein the providing a pre-determined plurality of elongated planks step includes providing planks of different lengths between the adjacent ones of the pre-determined plurality of posts, wherein the adjacent posts are spaced apart at different lengths, and wherein the plank contacts and fits securely between the adjacent posts.

7. The method of claim 1, wherein the sequences in which one of the pre-determined plurality of planks are lifted and repositioned includes lifting and repositioning a plank that contacts the post where the figurine is currently disposed.

8. The method of claim 7, wherein the sequences in which one of the pre-determined plurality of planks are lifted and repositioned includes lifting and repositioning the plank in a north-south or east-west orientation on the challenge card.

9. The method of claim 1, wherein the sequences in which one of the pre-determined plurality of planks are lifted and repositioned includes lifting and repositioning only one plank during each sequence.

10. A method of playing a computerized puzzle game, the method comprising:

providing a challenge card on a video display of a computer, the challenge card having a pre-determined plurality of posts patterned on pre-designated areas of the challenge card, and a pre-determined plurality of planks of different lengths patterned between adjacent ones of the pre-determined plurality of posts, wherein the pre-determined plurality of planks are initially positioned on pre-designated regions on the challenge card to thereby require sequences in which one of the pre-determined plurality of planks must be lifted and repositioned between others of the pre-determined plurality of posts to traverse the challenge card;

traversing the challenge card from a starting post patterned on one side to a finishing post patterned on an opposite side of the challenge card by using an input device for selecting a plank contacting the starting post and repositioning the plank between other adjacent posts; and continuing the selecting and repositioning steps for the planks from one adjacent post to another adjacent post until reaching the finishing post.

11. A method of claim 10, further comprising blocking a selecting and repositioning step if the step is contrary to rules embedded in the computerized puzzle game.

12. A method of playing a puzzle game, the method comprising:

providing a challenge card patterned on a suitable substrate, the challenge card having a pre-determined plurality of posts positioned on pre-designated areas of the challenge card;

providing a pre-determined plurality of elongated planks, each of the pre-determined plurality of planks being placed between adjacent ones of the pre-determined plurality of posts; and traversing the challenge card from one side to another side by moving from one segment to another, wherein each segment comprises traversing from one of the pre-determined plurality of posts to another of the pre-determined plurality of posts along one of the pre-determined plurality of planks disposed therebetween, and wherein the pre-determined plurality of planks are initially positioned on pre-designated regions on the challenge card to thereby require sequences in which one of the pre-determined plurality of planks must be lifted and repositioned between others of the pre-determined plurality of posts while traversing the challenge card.

13. A puzzle game, comprising:

a pegboard frame having a plurality of recesses therein;

a challenge card, the challenge card being disposed on an upper surface of the pegboard frame, the challenge card having a plurality of openings corresponding to certain ones of the plurality of recesses in the pegboard frame;

a pre-determined plurality of posts placed through the openings in the challenge card and contacting the recesses in the pegboard frame;

a pre-determined plurality of elongated planks, each of the pre-determined plurality of planks being placed between adjacent ones of the pre-determined plurality of posts and contacting the challenge card; and a figurine disposed at one side of the challenge card;

wherein the game comprises traversing the challenge card from the one side to another side by moving the figurine from one segment to another, wherein each segment comprises traversing from one of the pre-determined plurality of posts to another of the pre-determined plurality of posts along one of the pre-determined plurality of planks disposed therebetween, and wherein the plurality of planks are initially positioned on pre-designated regions on the challenge card to thereby require sequences in which one of the pre-determined plurality of planks must be lifted and repositioned between others of the pre-determined plurality of posts as the figurine traverses the challenge card.

14. The puzzle game of claim 13, wherein the challenge card further comprises a pattern printed on a surface thereof, the pattern including a river between opposing shores, and pre-designated regions identified on the challenge card for initially disposing the pre-determined plurality of planks on the pre-designated regions prior to commencing a game.

15. The puzzle game of claim 13, wherein a complexity of the challenge card pattern is determined by a number of the segments the figurine must traverse, the placement of the planks, a number of posts, and a number of the sequences of lifting and repositioning the planks.

16. The puzzle game of claim 13, wherein the challenge card is a universal challenge card having a plurality of openings corresponding to all of the plurality of recesses in the pegboard frame, thereby allowing selectivity in positioning the pre-determined plurality of posts and pre-determined plurality of planks.

17. The puzzle of claim 13, wherein the pre-determined plurality of elongated planks include planks of different lengths.

18. The puzzle of claim 13, wherein the figurine includes a magnet disposed in a base thereof, and each of the pre-determined plurality of elongated planks includes a magnet disposed in an underside thereof, thereby providing a magnetic coupling between the figurine and the plank during game play.

19. The puzzle of claim 13, wherein the posts are cylindrical shaped, and end portions of each of the plurality of elongated planks are curved inwardly to conform to the cylindrical shape of the posts, thereby providing a snug fit that precludes horizontal displacement while allowing vertical displacement to reposition the planks.

20. The puzzle of claim 13, wherein the posts comprise a designated outer shape, and end portions of each of the plurality of elongated planks are configured to conform to designated outer shape of the posts, thereby providing a snug fit that precludes horizontal displacement while allowing vertical displacement to reposition the planks.

* * * * *